United States Patent [19]

Walker

[11] Patent Number: 4,880,110

[45] Date of Patent: Nov. 14, 1989

[54] GRASPING MEANS ASSOCIATED WITH RETRIEVAL MEANS FOR INFUSION PACKAGES

[76] Inventor: Richard S. Walker, 189 Clifton St., Malden, Mass. 02148

[21] Appl. No.: 320,155

[22] Filed: Mar. 7, 1989

Related U.S. Application Data

[63] Continuation-in-part of Ser. No. 205,167, Jun. 10, 1988.

[51] Int. Cl.[4] ..... B65D 85/00

[52] U.S. Cl. ..... 206/0.5; 426/80; 426/83; 426/82

[58] Field of Search ..... 206/0.5; 426/77–84

[56] References Cited

U.S. PATENT DOCUMENTS

| | | | |
|---|---|---|---|
| 2,614,934 | 10/1952 | Trotman | 426/83 |
| 2,728,671 | 12/1955 | Young et al. | 426/82 |
| 2,800,408 | 7/1957 | Fimple | 426/80 |
| 2,860,989 | 11/1958 | Geisinoru | 206/0.5 |
| 3,899,599 | 8/1975 | Rambold | 426/82 |
| 4,735,810 | 4/1988 | Dacac | 206/0.5 |

*Primary Examiner*—Joseph Man-Fu Moy

*Attorney, Agent, or Firm*—Wolf, Greenfield & Sacks

[57] ABSTRACT

An improvement in tag-like grasping means located at the end of retrieval means for infusion bags including a shaped slit for forming an adjustable hook-like portion to clip the grasping means to the rim of substantially any container utilized for the infusion process. The shaped slit has a lower portion and an upper portion. The lower portion extends upwardly from an open end in the bottom edge of the grasping means adjacent the point of affixation of the retrieval means thereto to an upper end, and the upper portion extends from the upper end of the lower portion transversely across the grasping means above the point of affixation of the retrieval means to the grasping means to a closed end.

5 Claims, 2 Drawing Sheets

GRASPING MEANS ASSOCIATED WITH RETRIEVAL MEANS FOR INFUSION PACKAGES

This is a continuation in-part of my prior application, Ser. No. 07/205,167, of the same title, filed on June 10, 1988.

BACKGROUND OF THE INVENTION

I. Field of the Invention

The present invention relates generally to grasping means located at the end of retrieval means for tea bags and similar infusion packages. More particularly, the invention relates to improvements in such grasping means which enable the user to effectively hook or clip the grasping means to the rim of the cup or other container in which the infusion is to take place.

II. Summary of the Prior Art

Infusion envelopes or bags have existed in one form or another for many years, and for many years attempts have been made to facilitate their use by incorporating into or attaching to the envelopes or bags various forms of retrieval and/or grasping means, stirring means, and disposal means. The well-known and widely used tea bag, for example, exists in several forms, all of which embody the basic bag or envelope of porous, non soluble material, now usually paper, containing the tea, to which a tag or label is connected by a string or tape. These and similar infusion package combinations suffer from the lack of any means for preventing the tag from being carried into the container during the infusion process. This may occur, for example as a result of the force exerted by the bag on the string as the hot water is poured onto the bag located in the container to make the tea. Similarly, it may occur when the string or tape becomes entangled with a spoon or stirrer as the liquid is stirred to hasten the infusion process. Once the tag has been carried into the container, its removal requires the awkward use of a spoon or stirrer. Further, in the not infrequent circumstance that no spoon or stirrer is available, the use of the fingers is required—an unsanitary practice which is neither safe nor prudent in view of the high water temperatures necessary for the proper steeping of tea.

Numerous attempts have been made to solve this problem, but none have been totally successful. The majority of such attempts have been obviously too expensive to manufacture efficiently; and each, in addition, interfered significantly with use of the tea bag in the normal infusion (steeping) process.

One approach to the alleviation of this problem which was advocated by several inventors, was to incorporate the grasping means and the infusion bag into a single package. In these devices, a tag or flap of sufficient size to cover at least one side of the infusion bag was utilized as the grasping means. The bag was affixed directly to the grasping means, and in use was suspended by the grasping means either against the inner wall of, or over the middle of, the container. Disposal of the used bag was facilitated by the presence of the large flap which could be closed against at least one side of the bag. The added cost of material, and the required changes in manufacturing and packaging machinery were severe disadvantages to the commercial exploitation of these devices. Further, these devices suffered from drawbacks such as limiting the user in his ability to assist the infusion process by stirring, and that the use of these devices in a deep mug or other large container was impractical because the bag would not be effectively immersed in the infusing liquid. Typical of this approach are Christie (U.S. Pat. Nos. 4,726,956; 1988), Major (U.S. Pat. No. 3,387,978; 1968), Young (U.S. Pat. No. 2,728,672; 1955), and Maloney (U.S. Pat. No. 2,698,082; 1954). The Rambold patent (U.S. Pat. No. 3,895,118; 1975) presented a variation upon the above theme. In that device, the flaps were longer than the height of the bag, and it was suggested that the flaps be hooked together during use of the bag in various ways to allow the bag to be immersed in deeper containers while facilitating its retrieval, and to allow the infusion process to be assisted by the user. This device faced the same economic problems mentioned above, however, and still provided no means other than the length of the flaps for preventing the grasping means from being carried into a deep container.

Others, such as Barnett (U.S. Pat. No. 2,431,680; 1947), Cleaves (U.S. Pat. No. 2,291,278; 1942), and Abbott (U.S. Pat. No. 1,665,080; 1928), experimented with rigid or semi-rigid retrieval means, whereby the entire bag/tag assembly could be handled like a spoon. These devices, like the foldable cover member package of Irmscher (U.S. Pat. No. 3,566,573; 1971), which was designed for squeezing excess liquid from the bag upon its removal from the container, were both expensive to make and awkward to package.

The more direct approach to the problem was taken by Fant (U.S. Pat. 3,692,536; 1972), and Teapack (French Patent No. 1,319,654; 1962). In each of these patents, the inventor suggests the provision of a flap formed in the interior portion of a tag like grasping means having its closed end facing the point of affixation of the retrieval means to the tag. In Teapack, it is suggested that this flap provides an opening in the tag allowing the tag to be hooked over the spout of a teapot. The orientation and shape of the Teapack flap were specifically selected to facilitate this use of the tag. In Fant, it is suggested that the flap provide a means for retention of the tag on the edge of the infusion container. When the flap of either of these devices is hooked over the rim of a container, however, the point of attachment of the retrieval means to the tag is located above the rim of the container. This is an unstable configuration since the torque induced about the rim, by the inflow of fluid against the bag pulling upon the retrieval means, tends to dislodge the tag. Further, as the width of the rim of the container becomes large, the angle of the rim-engaging flap to the tag increases. Since the natural resilience of the tag material tends to close the flap towards the plane of the remainder of the tag, the point of attachment of the retrieval means to the tag will tend to rise relative to the rim of the container after its placement thereon by the user. In extreme cases, the tag will become totally dislodged from the container rim without the application of any external force. The instability of internal tag flaps, particularly in association with wide container rims, accordingly renders them unsatisfactory as retention means for the grasping means attached to the retrieval means for infusion bags or envelopes.

SUMMARY OF THE INVENTION

Therefore, it is an object of the present invention to provide a reliable and positive retention capability for conventional tea bag tags or similar infusion package grasping means.

It is also an object of the present invention to provide a retention means for grasping means of conventional infusion packages which includes an adjustment capability allowing the grasping means to be secured to container rims of varying thicknesses without adversely affecting the engagement of the retention means with the rim of the container.

Another object of the present invention is to provide a retention means for grasping means of conventional infusion packages which is inexpensive and easily incorporated into such grasping means without adverse effect upon the normal use of the infusion package.

To accomplish these and other objects of the present invention, the grasping means of a conventional infusion package of the type including an infusion bag connected to a grasping means, such as a label or tag, by a retrieval means, such as a string or tape, is provided with means for forming a hook-like portion to engage the rim of the infusion container. The means of the invention includes a shaped slit formed in the tag or label having a lower portion which extends upwardly from an open end located the bottom edge of the tag adjacent the affixation of the retrieval means thereto to an upper end, and an upper portion which extends transversely across the tag above the affixation of the retrieval means to the grasping means from the upper end of the lower portion to closed end.

In a preferred embodiment, the shaped slit takes the form of an inverted "L". The hook-like portion is formed when one side of the grasping means is deflected out of the plane of the tag. This causes the material of the tag to bend along a vertical line connecting the closed end of the slit and the top edge of the tag. The hook like portion so formed provides a reliable hook having the same depth for all uses of the tag, but can have a desired width necessary to accommodate the rim of any particular infusion container. Preferably , the depth of the hook-like portion will exceed its maximum width in order to assure adequate resistance to dislodgement of the tag from the container. The natural resilience of the material of the tag tends to close the hook against the sides of the container after its placement over the rim. This reduces the chance of inadvertent dislodgement of the tag. Further, since the preferred location of the point of attachment of the retrieval means to the grasping means in use is within the volume defined by the container at a depth equivalent the vertical height of the lower portion of the slit in all cases, the retention means will secure the grasping means to the rim against downward forces applied to it by the retrieval means in the same manner and with the same resistance to loss of the grasping means into the container in all cases. Still further, there is a reduced likelihood of tag tearing in response to downward forces on the retrieval means than was present in the prior art in which the inner and outer edges of the rim of the container, respectively, bore against opposite sides of the slit forming the internal flap in the tag adjacent its closed ends.

BRIEF DESCRIPTION OF THE DRAWINGS

These, as well as other features, advantages, and objects of the present invention, will be more clearly understood by reference to the following detailed description of the preferred embodiment thereof in view of the attached drawings, in which.

DETAILED DESCRIPTION OF PREFERRED EMBODIMENTS

In the following description, it will be understood that by the "top" of the tag or other grasping means, is meant the edge thereof furthest away from the string, tape or other retrieval means; and that by the "bottom" of the tag or other grasping means, is meant the edge to which, or near to which, the retrieval means connecting the grasping means to the infusion package is attached. It will also be understood that tags or other forms of grasping means in accordance with this invention may be made with any conventional machinery for the manufacture of such grasping means. The formed slit of this invention will be created as part of the same process by which the tag or other grasping means is stamped or otherwise cut to shape. This will require an inexpensive modification to existing machinery, and will in no way alter the cost of materials or the packaging for the infusion assembly. The grasping means may therefore be made of any of the flexible materials such as paper, cardboard or thin plastic now employed, and could be made of any other suitable material which may hereafter be developed or utilized for similar purposes.

Figure 1:
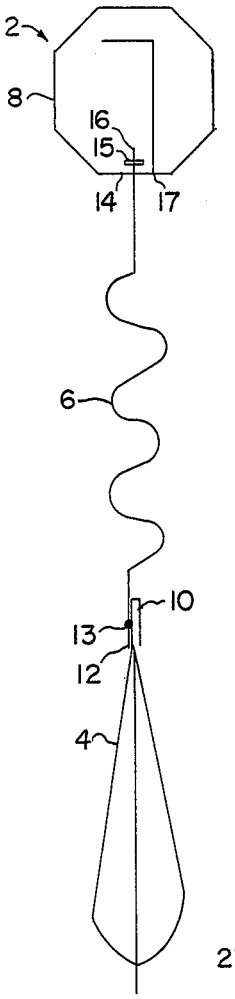
FIG. 1 is a plan view of an infusion bag/retrieval means/grasping means combination incorporating the present invention.

Referring now to the drawings, and particularly to FIG. 1, there is shown a conventional tea bag assembly generally indicated at 2. The assembly includes a porous envelope or bag 4 containing the material to be infused with surrounding liquid; a retrieval means 6, commonly a string or tape; and grasping means 8, commonly an octagonal tag or label. The retrieval means 6 is affixed to the top 10 of the envelope 4 adjacent its end 12 by a staple 13. Similarly, the retrieval means 6 is affixed adjacent its end 16 adjacent the bottom edge 14 of the grasping means 8 by a staple 15. In conventional use, the bag is placed in the container such that the retrieval means extends upwardly from the bag and over the rim of the container to the grasping means located outside of the volume defined by the container. The user may then grasp the grasping means to remove the bag from the container after the completion of the infusion process or to move the bag about within the liquid to facilitate the infusion process. As discussed above, the possibility of the loss of the grasping means into the liquid during the infusion process is a recurring problem.

Figure 2:
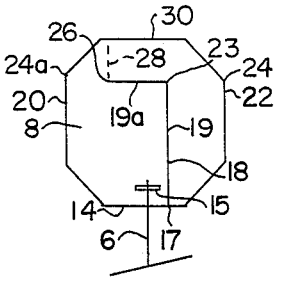
FIG. 2 is a plan view of an infusion bag grasping mean in accordance with the present invention showing in dotted lines the preferred bending line for the formation of the hook like portion.
Figure 3:
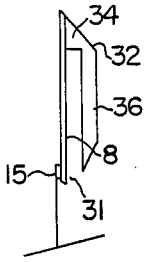
FIG. 3 is a right side view of the rasping means shown in FIG. 2 wherein the grasping means has been bent along the bending line shown in FIG. 2.
Figure 4:
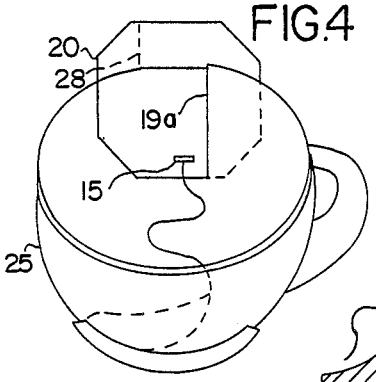
FIG. 4 is a perspective view of a thin-walled tea cup having a grasping means according to the present invention engaging its rim.
Figure 5:
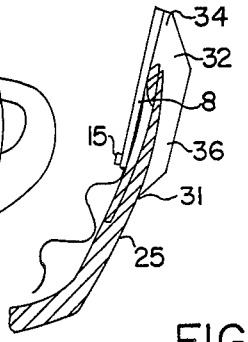
FIG. 5 is a partial sectional side view of the cup of FIG. 4 showing the engagement with its rim of a grasping means in accordance with the present invention.
Figure 8:
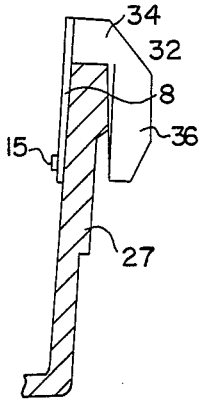
FIG. 8 is a partially sectional side view of the disposable cup of FIG. 7 showing the engagement of a grasping means in accordance with the present invention with its rim.
Figure 9:
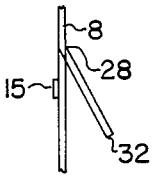
FIG. 9 is a top view of the grasping means of FIG. 8.
Figure 10:
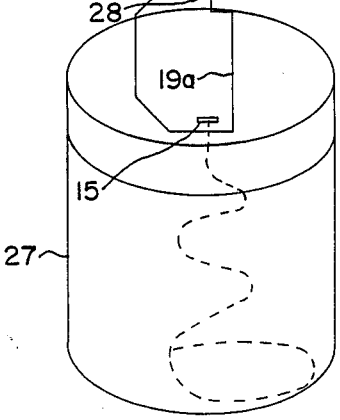
FIG. 10 is a perspective view of a wide rimmed container having a grasping means in accordance with the present invention engaging its rim.
Figure 11:
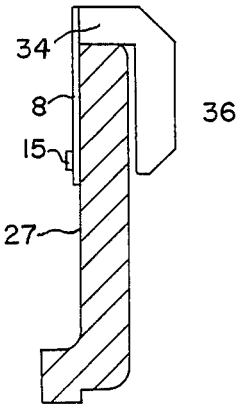
FIG. 11 is a partial sectional side view of the container of FIG. 10 showing a grasping means in accordance with the present invention engaging its rim.
Figure 12:
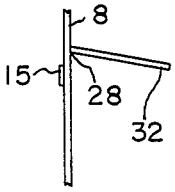
FIG. 12 is a top view of the grasping means of FIG. 11.
Figure 13:
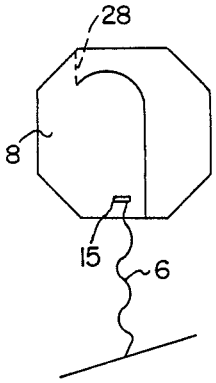
FIG. 13 is a plan view of another grasping means in accordance with the present invention wherein the slit is in an inverted "J" configuration.
Figure 14:
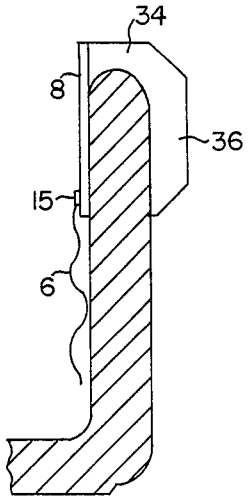
FIG. 14 is a side view of a container in partial section showing the engagement of the grasping means of FIG. 13 with its rim.
Figure 15:
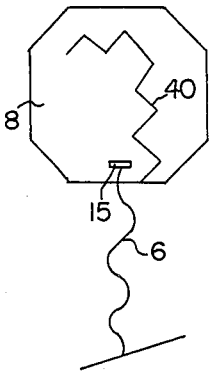
FIG. 15 is a plan view of yet another grasping means in accordance with the present invention wherein both the lower and the upper portions of the slit are longer than the linear distance between their respective ends.
Figure 16:
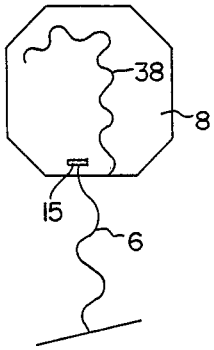
FIG. 16 is a plan view of an alternative grasping means in accordance with the present invention similar to the grasping means shown in FIG. 15.

The present invention provides means in the form of a shaped slit 18 in the grasping means 8, best seen in FIG. 2, to solve this problem. In a preferred form, this shaped slit includes a lower portion 19 which runs vertically upwardly from an open end 17 in the bottom edge 14 of the grasping means 8 adjacent staple 15 toward the top thereof substantially parallel to the side edges 20 and 22 to a point 23 located on a line running between corners 24 and **24*a*. From point 23, an upper portion 19*a* of the slit extends transversely, i.e., generally parallel to edge 14, across grasping means 8 above the staple 15 to a closed end 26. The lower portion 19 is longer than the upper portion 19*a* so that the slit 18 has an inverted "L" shape. Either, or both, of the portions 19 and 19*a* of slit 18 may be longer than the longitudinal distance between their ends as shown, for example, in FIGS. 13 (inverted "J") and 14. FIGS. 15 and 16 show a modification wherein the slit 18 includes minor convolutions 38 or saw toothed notches 40, along its length. These convolutions may facilitate the forming operation. They may also enhance the ability of the hook-like portion to grasp the edge of the container 27, particularly in cases wherein the walls of the container are formed of soft foam or the like, and in cases wherein the exterior surface of the container is ribbed, as shown in FIG. 8**.

There are various sizes and shapes of grasping means peculiar to each of the many manufacturers of such devices. It is to be understood that the location of the slit of the present invention is not critical, and may be varied to accommodate any of the presently available grasping means' shapes or any other shape yet to be utilized for this purpose. The benefit of the invention is obtained as long as the lower end of the lower portion of the slit opens into the bottom edge of the grasping means adjacent its center line, and utilizes the natural strength and resiliency of the material of the grasping means in the creation of a hook-like portion for the retention of the grasping means upon the edge of the infusion container as will be described in more detail below.

Figure 6:
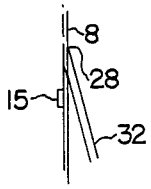
FIG. 6 is a top view of a grasping means in accordance with the present invention adjusted to fit the rim of a thin walled tea cup.
Figure 7:
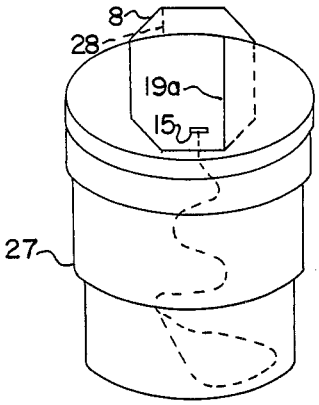
FIG. 7 is a perspective view of a disposable cup having a grasping means in accordance with the present invention engaging its rim.

The operation of the present invention will be best understood by reference to FIGS. 2–12. It will be understood that conventional grasping means, i.e., tags, modified in accordance with this invention will tend to bend along line 28 running from point 26 to the top edge 30 of the grasping means 8 in response to deflecting forces applied to side 20 or 22. It will also be recognized that the grasping means 8 is resistant to tearing along line 28 in response to downward forces exerted upon the tag by the retrieval means. Additionally, it will be recognized by those skilled in the art that the materials from which grasping means are usually formed have inherent resiliency even when creased. It will therefore be seen that the grasping means of the present invention may be sized to fit substantially any conventionally available container rim by varying the bend along line 28, while at the same time retaining essentially the same resistance to downward forces applied to it by the retrieval means. For example, FIGS. 3–6, show a grasping means in accordance with the preferred embodiment sized to fit over the narrow rim of a teacup 25. The bend (along line 28) is slight, as shown in FIG. 6. This results in the width 31 of the hook-like extension 32 being narrow. A slightly greater bend, as in FIG. 9, results in a wider hook like extension, as in FIGS. 7 and 8. Similarly, a full right angle bend (along line 28), as in FIG. 12, results in the widest possible hook like extension, as in FIGS. 10 and 11.

Two further features inherent in this attachment means are important. First, the natural resiliency of the material tends to flatten the bend at line 28, i.e., to pull the material of the hook-like extension back toward the plane of the grasping means. This provides a small retention force which tends to inhibit the inadvertent dislodgement of the grasping means from the rim. Second, the preferred disposition of the grasping means upon the rim of the container is with the point of affixation of the retrieval means to the grasping means located adjacent the inner wall of the container and with the inner edge of the hook-like extension bearing against the outer wall of the container. This is an extremely stable configuration. Vertical forces pulling downwardly upon the retrieval means act against the cross portion 34 of the hook like extension. Thus, these forces tend to enhance the engagement of the hook-like portion with the rim and they are resisted by the material of the cross portion which is located with respect to the rim in the orientation which provides the greatest resistance to bending. Tearing of the grasping means is also less likely than it would be if the inner and outer edges of the rim bore against opposite sides of the slit adjacent its closed end. Further, any inwardly directed force applied to the top of the grasping means is resisted by the downwardly projecting portion 36 of the hook-like extension.

Numerous alterations, modifications, and adaptations of the present invention will occur to those skilled in the art in view of the foregoing detailed description of a preferred embodiment. It is my intention that this description be understood as illustrative only and that the invention be limited only by the terms of the appended claims.

I claim:

1. An infusion package comprising a bag-like member of porous, non-soluble material adapted to receive and contain material to be infused by external liquid; elongated retrieval means having a first end and a second end, said retrieval means being affixed adjacent said first end to said bag-like member; and tag-like grasping means having a top edge, first and second side edges, and a bottom edge, said grasping means being affixed to said second end of said retrieval means adjacent its bottom edge, and including means for forming a hook-like portion adapted to be secured over the rim of the container in which the infusion process is to take place with the point of affixation of said retrieval means to said grasping means located within the volume defined by said container; said means for forming a hook-like portion comprising a shaped slit having a lower portion extending generally upwardly from an open end located in the bottom edge of said grasping means adjacent the point of affixation of said retrieval means to said grasping means to an upper end, and a upper portion extending transversely across said grasping means above said point of affixation of said retrieval means to said grasping means from said upper end of said lower portion of said slit to a closed end; whereby said hook-like portion may be adjusted to fit over rims of varying thickness to resist dislodgement by bending or tearing caused by forces applied to said grasping means by said retrieval means, and whereby the inadvertent loss o the grasping means into said container may be avoided, both without impediment to the normal operation of the infusion package combination.

2. The infusion package combination of claim 1 wherein the slit has an inverted "L" shape.

3. The infusion package combination of claim 1 wherein the slit has an inverted "J" shape.

4. The infusion package combination of claim 1 wherein the lower and the upper portions of said slit are longer than the direct linear distance between their respective ends.

5. The infusion package of claim 1 wherein the infusion package is a tea bag.

* * * * *